United States Patent [19]

Farr

[11] Patent Number: 4,802,250

[45] Date of Patent: Feb. 7, 1989

[54] SELF-ALIGNMENT BEDDING

[76] Inventor: Richard S. Farr, 2257 Century Hill, Los Angeles, Calif. 90067

[21] Appl. No.: 58,912

[22] Filed: Jun. 5, 1987

Related U.S. Application Data

[63] Continuation-in-part of Ser. No. 725,649, Apr. 22, 1985, abandoned.

[51] Int. Cl.[4] ..... A47G 9/00

[52] U.S. Cl. ..... 5/482; 5/488; 5/495; 5/499

[58] Field of Search ..... 5/482, 487, 495, 497, 5/496, 499, 488, 486

[56] References Cited

U.S. PATENT DOCUMENTS

| | | | |
|---|---|---|---|
| D. 209,948 | 1/1968 | Peterson . | |
| 1,867,425 | 7/1932 | Swetzel | 5/485 |
| 2,577,178 | 12/1951 | Bellinger | 5/485 |
| 2,772,425 | 12/1956 | Brodie | 5/485 |
| 3,654,646 | 4/1972 | McMahon | 5/485 |
| 3,849,813 | 11/1974 | Neilson | 5/495 |
| 3,868,735 | 3/1975 | Ross | 5/497 |
| 3,900,909 | 8/1975 | Monier | 5/496 |
| 3,965,504 | 6/1976 | Ainsworth | 5/496 X |
| 4,274,169 | 6/1981 | Standiford | 5/502 |
| 4,651,371 | 3/1987 | Hahn | 5/497 |

FOREIGN PATENT DOCUMENTS

| | | | |
|---|---|---|---|
| 1166345 | 11/1958 | France | 5/482 |
| 2481096 | 10/1981 | France | 5/495 |
| 2483760 | 12/1981 | France | 5/495 |

*Primary Examiner*—John E. Murtagh
*Assistant Examiner*—Andrew Joseph Rudy
*Attorney, Agent, or Firm*—Lyon & Lyon

[57] ABSTRACT

Bedding for use a rectangular mattress which defines indicia thereon for alignment with the mattress to facilitate making the bed. The indicia includes a first transverse mattress foot alignment indicator and a mattress centering indicator. The foot alignment indicator is spaced inwardly from and extends parallel to the foot end of the bedding such that upon properly positioning the bedding on the mattress, the foot indicator is disposed over and extends parallel to the foot of the mattress and the centering indicator is disposed over a portion of the mattress so as to superimpose the central longitudinal axis of the bedding over the central longitudinal axis of the mattress.

5 Claims, 1 Drawing Sheet

SELF-ALIGNMENT BEDDING

This a continuation-in-part of now abandoned application, Ser. No. 725,649, filed Apr. 22, 1985 and entitled Bed Sheet.

BACKGROUND OF THE INVENTION

A common problem in making up beds is quickly discerning the length from the width of the sheets and blankets. While through practice one can learn to overcome this problem through developed familarity with the variations in the width and length dimensions, the uninitiated is generally faced with the trial by error approach, particularly with queen and king size beds when the difference between the width and length of the sheets and blankets is not so readily apparent. This problem becomes more acute when one unfamiliar with bedmaking is forced to care for an ill spouse and the seemingly simple task can be quite aggravating. It would be highly desirable to develop a means whereby the sheets and blankets would be provided with alignment indicators which could inform the bedmaker as to the proper alignment of the sheet or blanket on the bed mattress without adversely affecting the comfort or appearance of the sheet or blanket and without significantly increasing the costs thereof. The present invention provides such a sheet.

SUMMARY OF THE INVENTION

Briefly, the present invention relates to bed sheets and blankets which define a footprint of a mattress thereon for properly aligning the sheet or blanket with the bed to facilitate making of the bed. More particularly, the sheet of the present invention has a generally "U-shaped" pattern imprinted thereon for defining the footprint of the mattress such that the upstanding leg portions of the pattern are adapted to be disposed generally above and parallel to the lateral sides of the mattress and the horizontal bar portion of the pattern is disposed above and parallel to the foot of the mattress. To enable non-contoured sheets to be aligned for use as both top and bottom sheets, a second horizontal bar is disposed below and spaced from the bar portion of the U-shaped pattern such that the second bar extends parallel to the first bar portion. When used as bottom sheet, the second bar is disposed above and parallel to the foot end of the mattress so as to extend the head of the sheet a predetermined distance beyond the head of the mattress so that the sheet can be tucked thereunder. When used as a top sheet or on a blanket, the first bar is aligned with the foot of the mattress so as to, in the case of the sheet, extend the head of the sheet a second predetermined distance such that the sheet can be folded back over the exposed end of the blanket and in the case of the blanket properly aligned the blanket on the mattress.

DESCRIPTION OF THE PREFERRED EMBODIMENT

Figure 1:
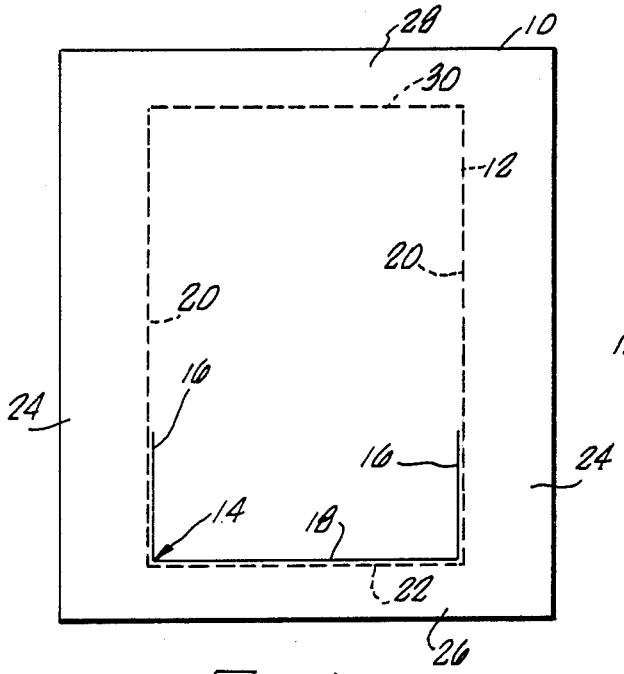
FIG. 1 is a top view of a sheet of the present invention disposed above a bed mattress.

FIG. 1 illustrates a flat sheet 10 of the present invention disposed above and in alignment with a bed mattress 12. The sheet 10 is provided with an alignment pattern 14 comprised of a plurality of indicia to identify the footprint of the mattress 12. In the preferred embodiment of the invention, the pattern 14 is generally U-shaped and comprises a pair of upstanding parallel leg portions 16 and a perpendicularly disposed linear bar portion 18. The pattern 14 is sized on the sheet such that when the sheet 10 is properly aligned with the mattress 12, the leg portions 16 are disposed generally over and parallel to the lateral sides 20 of the mattress and the bar portion 18 is disposed directly over and extends parallel to the foot 22 of the mattress 12. So aligned, one only needs to fold the lateral portions 24 of the sheet about and under the lateral sides 20 of the mattress and the projecting foot portion 26 of the sheet about and under the foot 22 of the mattress. Depending on whether the sheet 10 is used as a bottom or top sheet, the head portion 28 of the sheet is folded over and under the head 30 of the mattress or back over the blanket (not shown). It is to be understood that the U-shaped alignment pattern 14 can also be provided on a bottom contour sheet and utilized in the manner described above.

Figure 2:
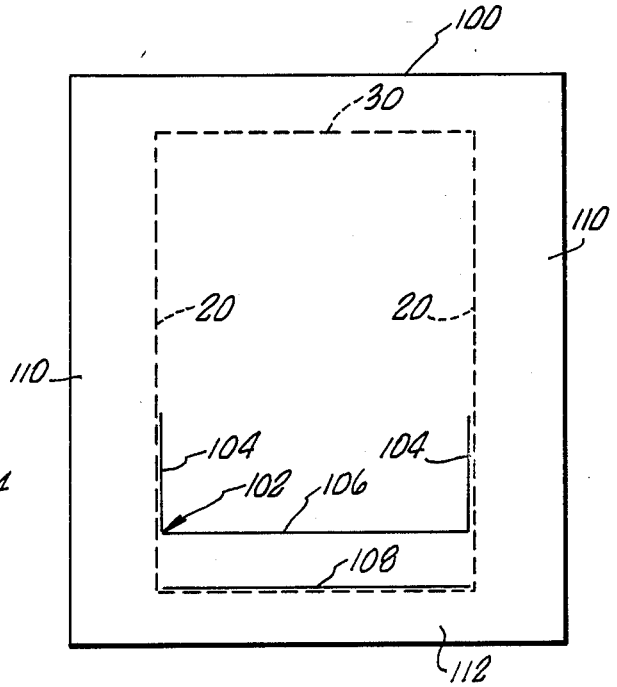
FIG. 2 is a top view of a second embodiment of a sheet of the present invention disposed above a bed mattress and positioned for use as a top sheet.
Figure 3:
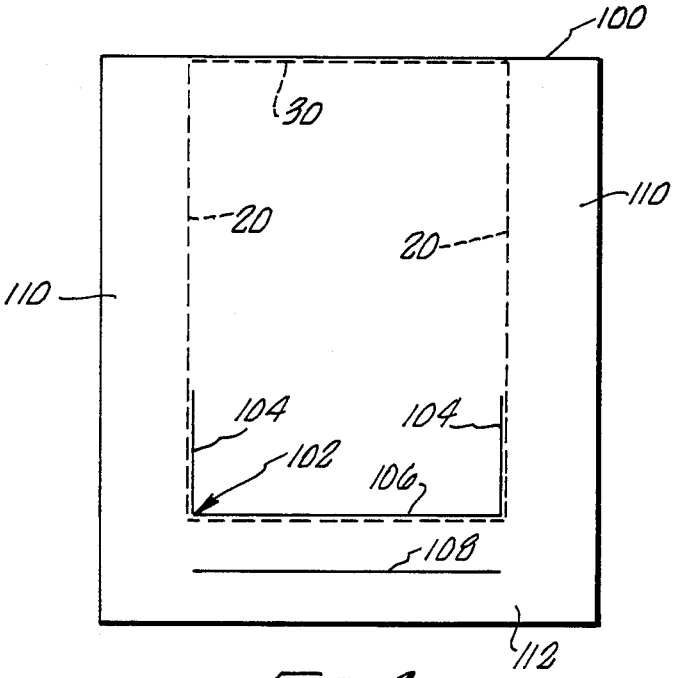
FIG. 3 is a top view of a second embodiment of a sheet of the present invention disposed above a bed mattress and positioned for use as a bottom sheet.

FIGS. 2 and 3 illustrate an alternate embodiment of the invention wherein the sheet 100 is provided with a generally U-shaped alignment pattern 102 comprising a pair of upstanding parallel leg portions 104 and a perpendicularly disposed linear bar portion 106. A second linear bar 108 is disposed below bar portion 106, preferably about 8 to 10 inches, and extends parallel thereto. Sheet 100 is a flat sheet adapted for alignment and use as both a top and bottom sheet. While sheet 10 of the prior embodiment can also be utilized as both a top and bottom sheet in a flat configuration, this embodiment provides more precise linear alignment of the sheet with the mattress in the lengthwise direction for both top and bottom sheet use.

FIG. 2 illustrates sheet 100 used as a top sheet. As seen therein, the U-shaped alignment pattern 102 is utilized in the same manner as in the prior embodiment, with the leg portions 104 being disposed generally above and parallel to the lateral sides 20 of the mattress 12 and the bar portion 106 being directly above and parallel to the foot 22 of the mattress 12. The second lower bar 108 is not utilized when sheet 100 is used as a top sheet. So positioned, the lateral side portions 110 and foot portions 112 of the sheet can be folded about and under the sides and foot of the mattress leaving a predetermined length of sheet at the head thereof to be neatly folded back over the exposed end of the blanket (not shown).

FIG. 3 illustrates sheet 100 used as a bottom sheet. In securing sheet 100 as a bottom sheet, the parallel leg portions 104 of the alignment pattern 102 are again disposed generally over and parallel to the lateral sides of the mattress, but the second lower bar 108 is now aligned with the foot of the mattress thereby shifting the sheet 100 toward the head of the mattress a distance equal to the spacing between bars 106 and 108, preferably about 8 to 10 inches, to provide a predetermined amount of material necessary to neatly fold the head of sheet 100 over and under the head of the mattress.

It is to be understood that the parallel leg portions 16 and 104 which define the lateral placement indicia need not be spaced apart a distance equal to the width of the mattress so long as they approximate the width thereof or otherwise assist in the centering of the sheet on the mattress. However, one of the bar portions 18, 106 or 108 which define the length placement indication should be aligned directly over the foot of the mattress to insure proper longitudinal positioning of the sheet on the bed. The alignment members can be provided on the sheet material in any conventional manner but should be of sufficient contrasting color so as to readily discernable.

In addition to use on sheets, the alignment pattern 102 without the second lower bar 108 could be employed on a blanket to assist in aligning the blanket with the mattress in the same manner in which the sheets are aligned. The term bedding is used herein to include both sheets and blankets.

In a modification of the present invention a single centering indicator (not shown) could be employed for centering the bedding on the mattress in lieu of the two leg portions 104. Various other changes and modifications may be made in carrying out the present invention without departing from the spirit and scope thereof. Insofar as these changes and modifications are within the purview of the appended claims, they are to be considered as part of the present invention.

I claim:

1. A bedding having a central longitudinal axis adapted for use on and alignment with foot and sides of a rectangular mattress having a central longitudinal axis to facilitate making of a bed, said bedding comprising a flat substantially rectangular sheet of material defining a foot end, a head end and a plurality of mattress alignment indicators disposed on said sheet adjacent said foot end thereof, said indicators including a first transverse mattress foot alignment indicator and a mattress centering indicator, said foot alignment indicator being spaced inwardly from and extending parallel to said foot end of said bedding such that upon said bedding being positioned on said mattress for securement thereto, said foot alignment indicator is disposed over and extends parallel to the foot of the mattress and said centering indicator is disposed over a portion of said mattress so as to superimpose the central longitudinal axis of said bedding over the central longitudinal axis of the mattress.

2. The bedding of claim 1 wherein said foot alignment indicator defines a first bar and said centering indicator comprises a pair of parallel lateral side alignment bars extending perpendicularly with respect to said first bar such that upon the central longitudinal axes of said bedding and the mattress being superimposed, said lateral side alignment bars are substantially aligned with and extend parallel to the sides of the mattress.

3. The bedding of claim 2 wherein said bedding comprises a sheet and including a second transverse mattress foot alignment bar spaced toward the foot end of said sheet from said first transverse foot alignment bar and extending parallel thereto such that upon disposing said second transverse foot alignment bar over and parallel to the foot of the mattress, the head end of said sheet can be folded over and under the mattress for use as a bottom sheet.

4. A bed sheet having a central longitudinal axis adapted for use on and alignment with foot and sides of a rectangular mattress having a central longitudinal axis to facilitate making of a bed, said sheet comprising a flat substantially rectangular sheet of material defining a foot end, a head end and a substantially "U-shaped" mattress alignment indicator disposed on said sheet adjacent the foot end thereof, said indicator including a first transverse foot alignment bar spaced inwardly from and extending parallel to said foot end of said sheet and a pair of parallel lateral side alignment bars extending perpendicularly to said first transverse foot alignment bar, said bars being positioned on said sheet such that upon disposing said sheet on the mattress to make the bed such that the central longitudinal axis of said sheet is superimposed on the central longitudinal axis of the mattress and the head end of said sheet is in a desired spacial relationship with the head end of the mattress, said first transverse foot alignment bar is parallel to and in alignment with the foot of the mattress and said lateral side alignment bars extend parallel to and are substantially aligned with the sides of the mattress.

5. A bed sheet having a central longitudinal axis adapted for use as a top sheet and a bottom sheet on a rectangular mattress having a central longitudinal axis and for alignment with head, foot and sides thereof to facilitate making of a bed, said sheet comprising a flat substantially rectangular flat sheet of material defining a foot end, a head end and a substantially U-shaped mattress alignment indicator disposed on said sheet adjacent the foot end thereof said indicator including a first transverse foot alignment bar spaced inwardly from and extending parallel to said foot end of said sheet and a pair of parallel lateral side alignment bars extending perpendicularly to said first transverse foot alignment bar, and a second transverse foot alignment bar disposed parallel to and spaced between said first transverse foot alignment bar and the foot of said mattress, said bars being positioned on said sheet such that upon disposing said sheet on the mattress for use as a to sheet in making the bed such that the central axis of said sheet is superimposed in the central axis of the mattress and the head end of the sheet is substantially aligned with the head of the mattress, said first transverse foot alignment bar is parallel to and in alignment with the foot of the mattress and said lateral side alignment bars are parallel to and substantially aligned with the sides of the mattress and upon disposing said sheet on the mattress for use as a bottom sheet such that the head of said sheet can be folded under the mattress, the second transverse foot alignment bar is disposed parallel to and in alignment with the foot of the mattress and said lateral side alignment bars are parallel to and substantially aligned with the sides of the mattress.

* * * * *